US008678952B2

(12) United States Patent
Shinohara et al.

(10) Patent No.: US 8,678,952 B2
(45) Date of Patent: Mar. 25, 2014

(54) GOLF BALL

(71) Applicant: Bridgestone Sports Co., Ltd., Minato-ku (JP)

(72) Inventors: Hirotaka Shinohara, Chichibu (JP); Hiroshi Higuchi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 13/860,175

(22) Filed: Apr. 10, 2013

(65) Prior Publication Data

US 2013/0225327 A1 Aug. 29, 2013

Related U.S. Application Data

(60) Division of application No. 12/551,671, filed on Sep. 1, 2009, now Pat. No. 8,435,138, which is a continuation-in-part of application No. 11/934,335, filed on Nov. 2, 2007, now Pat. No. 7,604,553.

(51) Int. Cl.
*A63B 37/04* (2006.01)
*A63B 37/12* (2006.01)

(52) U.S. Cl.
USPC ..... 473/377; 473/378

(58) Field of Classification Search
USPC ..... 473/351–385
See application file for complete search history.

(56) References Cited

U.S. PATENT DOCUMENTS 5,502,100 A * 3/1996 Maruoka et al. ..... 524/430
5,506,292 A 4/1996 Horiuchi et al.
5,540,438 A * 7/1996 Horiuchi et al. ..... 473/376
5,688,595 A * 11/1997 Yamagishi et al. ..... 428/375
5,711,723 A 1/1998 Hiraoka et al.
5,772,531 A 6/1998 Ohsumi et al.
5,803,831 A 9/1998 Sullivan et al.
5,816,937 A 10/1998 Shimosaka et al.

(Continued)

FOREIGN PATENT DOCUMENTS

JP 06-254180 A 9/1994
JP 7-8575 A 1/1995

(Continued)

OTHER PUBLICATIONS

Japanese Office Action dated Oct. 31, 2012 issued in Japanese Patent Application No. 2008-279162.

*Primary Examiner* — Alvin Hunter
(74) *Attorney, Agent, or Firm* — Sughrue Mion, PLLC

(57) ABSTRACT

The invention provides a multi-piece solid golf ball having a core of at least one layer, a cover of at least two layers which includes an inner cover layer and an outermost cover layer, and a plurality of dimples formed on a surface of the ball. The thickness and Shore D hardness of the outermost cover layer are set in specific ranges, the thickness and Shore D hardness of the inner cover layer are set in specific ranges, and the ball surface has, as expressed in the Lab color system defined by JIS Z-8730, a lightness L value of at least 89, an a value of at least 2 but not more than 10, and a b value of −20 or above. The multi-piece solid golf ball of the invention increases the reddish coloring of a white golf ball, thereby enhancing the stylishness of the ball and improving the way the ball looks and feels to the golfer when it is played.

6 Claims, 1 Drawing Sheet

(56) References Cited

U.S. PATENT DOCUMENTS

| | | | | |
|---|---|---|---|---|
| 5,823,890 | A * | 10/1998 | Maruko et al. | 473/354 |
| 6,022,279 | A | 2/2000 | Yamagishi et al. | |
| 6,045,460 | A | 4/2000 | Hayashi et al. | |
| 6,123,630 | A | 9/2000 | Hayashi et al. | |
| 6,194,505 | B1 | 2/2001 | Sone et al. | |
| 6,224,499 | B1 * | 5/2001 | Ogg | 473/383 |
| 6,231,461 | B1 | 5/2001 | Moriyama et al. | |
| 6,248,027 | B1 | 6/2001 | Hayashi et al. | |
| 6,336,870 | B1 * | 1/2002 | Kato et al. | 473/351 |
| 6,416,425 | B1 | 7/2002 | Maruko et al. | |
| 6,435,984 | B1 * | 8/2002 | Ohama | 473/377 |
| 6,468,169 | B1 | 10/2002 | Hayashi et al. | |
| 6,527,652 | B1 | 3/2003 | Maruko et al. | |
| 6,561,923 | B1 | 5/2003 | Ohama et al. | |
| 6,565,455 | B2 | 5/2003 | Hayashi et al. | |
| 6,642,314 | B2 | 11/2003 | Sone et al. | |
| 6,676,543 | B2 * | 1/2004 | Endo | 473/378 |
| 6,716,166 | B2 | 4/2004 | Govari | |
| 6,786,836 | B2 | 9/2004 | Higuchi et al. | |
| 6,793,593 | B2 | 9/2004 | Binette et al. | |
| 6,981,925 | B2 | 1/2006 | Shimizu et al. | |
| 7,128,665 | B2 | 10/2006 | Fushihara | |
| 7,153,224 | B2 | 12/2006 | Higuchi et al. | |
| 7,207,904 | B2 * | 4/2007 | Isogawa et al. | 473/378 |
| 7,238,121 | B2 | 7/2007 | Watanabe et al. | |
| 7,262,235 | B2 * | 8/2007 | Bulpett et al. | 524/91 |
| 7,267,623 | B2 | 9/2007 | Manami et al. | |
| 7,294,680 | B2 | 11/2007 | Sone et al. | |
| 7,357,732 | B2 | 4/2008 | Watanabe et al. | |
| 7,604,553 | B2 | 10/2009 | Shinohara | |
| 2003/0134694 | A1 | 7/2003 | Watanabe et al. | |
| 2006/0047080 | A1 | 3/2006 | Higuchi et al. | |
| 2006/0128504 | A1 | 6/2006 | Watanabe et al. | |
| 2009/0118039 | A1 | 5/2009 | Shinohara | |

FOREIGN PATENT DOCUMENTS

| | | | |
|---|---|---|---|
| JP | 07-051403 | A | 2/1995 |
| JP | 07-059879 | A | 3/1995 |
| JP | 09-248351 | A | 9/1997 |
| JP | 10-127818 | A | 5/1998 |
| JP | 10-127819 | A | 5/1998 |
| JP | 10-155937 | A | 6/1998 |
| JP | 10-295852 | A | 11/1998 |
| JP | 10-325327 | A | 12/1998 |
| JP | 10-325328 | A | 12/1998 |
| JP | 10-328325 | A | 12/1998 |
| JP | 10-328326 | A | 12/1998 |
| JP | 11-004916 | A | 1/1999 |
| JP | 11-035633 | A | 2/1999 |
| JP | 11-164912 | A | 6/1999 |
| JP | 11-216200 | A | 8/1999 |
| JP | 2000-024136 | A | 1/2000 |
| JP | 2001-017576 | A | 1/2001 |
| JP | 2001-218873 | A | 8/2001 |
| JP | 2002-126132 | A | 5/2002 |
| JP | 2002-136621 | A | 5/2002 |
| JP | 2002-293996 | A | 10/2002 |
| JP | 2002-355338 | A | 12/2002 |
| JP | 2004-180822 | A | 7/2004 |
| JP | 2007-75600 | A | 3/2007 |
| JP | 2007-136170 | A | 6/2007 |

* cited by examiner

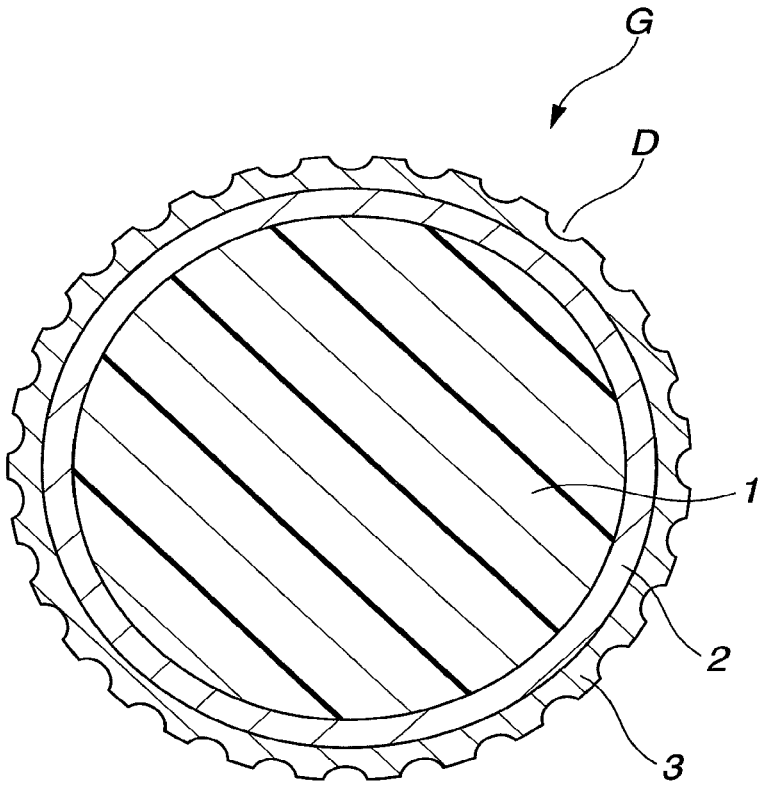
G
D
1
2
3

GOLF BALL

CROSS-REFERENCE TO RELATED APPLICATIONS

This is a Divisional application of U.S. application Ser. No. 12/551,671 filed Sep. 1, 2009, which is a Continuation-In-Part of U.S. application Ser. No. 11/934,335 filed on Nov. 2, 2007, now U.S. Pat. No. 7,604,553 issued Oct. 20, 2009. The entire contents of the prior applications are hereby incorporated by reference.

BACKGROUND OF THE INVENTION

The present invention relates to a golf ball which is a white ball tinged with red, and is endowed with both stylishness and a quality feel.

Conventional white golf balls have a strongly yellowish or bluish cast. To date, there have been no golf balls which are entirely satisfactory both in terms of stylishness and how the ball looks and feels to the golfer.

Generally, even when the shape and size of the design are the same, the way in which the size and hardness of a golf ball are perceived can vary significantly depending on the coloration of the cover. Hence, it is desirable to adjust such coloration from the perspective of the golfer.

Conventional blue golf balls include those disclosed in JP-A 11-216200, JP-A 07-059879, JP-A 07-051403, JP-A 06-254180, JP-A 2001-017576, JP-A 2002-126132 and JP-A 2007-136170. These golf balls have a strongly bluish coloring, which often makes them feel colder and harder. In general, the distance traveled by a golf ball tends to decrease under low temperature conditions. Hence, a ball that feels colder and harder often disrupts the golfer's swing.

Golf balls having a yellowish coloring like that disclosed in JP-A 2002-136621 often appear to have yellowed, making them seem old and lacking in stylishness, which is undesirable in terms of appearance.

The golf ball described in JP-A 2000-024139 is a colored golf ball having a strong pink or orange coloring. Such golf balls differ markedly from ordinary golf balls in their brightness and how they are perceived.

It is therefore an object of the present invention to provide a golf ball which, in spite of being a white ball, has a quality feel (luxurious character) and stylishness, giving it a high commercial value, which has an apparent hardness that substantially agrees with the actual ball hardness, and which can be comfortably played because it feels "right" to the golfer at the time of impact.

SUMMARY OF THE INVENTION

As a result of extensive investigations aimed at achieving the above object, the inventor has discovered that by intensifying the red hue in a white golf ball, the appearance of the golf ball is changed and the way the ball looks and feels to the golfer when played can be improved.

Accordingly, the invention provides the following golf balls.

[I] A multi-piece solid golf comprising a core of at least one layer, a cover of at least two layers which includes an inner cover layer and an outermost cover layer, and a plurality of dimples formed on a surface of the ball, wherein the outermost cover layer has a thickness of from 0.5 to 1.8 mm and a Shore D hardness of from 40 to 65, the inner cover layer has a thickness of from 0.5 to 4.0 mm and a Shore D hardness of from 40 to 70, the outermost cover layer is softer than the inner cover layer, and the ball surface has, as expressed in the Lab color system defined by JIS Z-8730, a lightness L value of at least 89, an a value of at least 2 but not more than 10, and a b value of −20 or above.

[II] A multi-piece solid golf comprising a core of at least one layer, a cover of at least two layers which includes an inner cover layer and an outermost cover layer, and a plurality of dimples formed on a surface of the ball, wherein the outermost cover layer has a thickness of from 1.0 to 2.3 mm and a Shore D hardness of from 50 to 65, the inner cover layer has a thickness of from 0.5 to 4.0 mm and a Shore D hardness of from 30 to 60, the outermost cover layer is harder than the inner cover layer, and the ball surface has, as expressed in the Lab color system defined by JIS Z-8730, a lightness L value of at least 89, an a value of at least 2 but not more than 10, and a b value of −20 or above.

The tendency with colors is for the lightness of a color to relate closely to the way in which size, hardness and weight are perceived. At the same degree of lightness, a warm color makes an object appear larger than does a cold color. Compared with the actual hardness and weight of a colored object, cold colors give an impression of greater hardness and weight that do warm colors. Therefore, in the present invention, by intensifying the reddish (warm) coloring and selecting a suitable lightness value, a golf ball is provided which has a suitable look and feel to the golfer before being played and on which the design and other markings are fully and effortlessly visible.

BRIEF DESCRIPTION OF THE DIAGRAM

FIGURE is a cross-sectional view of a multi-piece solid golf ball according to an embodiment of the invention.

DETAILED DESCRIPTION OF THE INVENTION

The invention is described more fully below.

The present invention provides a multi-piece solid golf having a core of at least one layer, a cover of at least two layers which includes an inner cover layer and an outermost cover layer, and a plurality of dimples formed on a surface of the ball. More specifically, referring to FIG. 1, the inventive ball may be exemplified by a multi-piece solid golf ball G which has at least a three-layer construction composed of a solid core 1, an inner cover layer 2 encasing the solid core 1, and an outermost cover layer 3 encasing the inner cover layer, and which has a plurality of dimples D formed on a surface of the outermost cover layer 3. Here, in FIG. 1, the ball has been given a three-layer construction composed of a solid core 1, an inner cover layer 2 and an outermost cover layer 3. However, the solid core may be given a multilayer construction of two or more layers; if necessary, an intermediate cover layer may be provided between the inner cover layer and the outermost cover layer.

The material making up the above core is not subject to any particular limitation; a known rubber composition may be employed. For example, use may be made of a rubber composition obtained by blending into a base rubber such as polybutadiene: a co-crosslinking agent such as an unsaturated carboxylic acid or a metal salt thereof, an inorganic filler such as zinc oxide, barium sulfate, calcium carbonate or titanium oxide, and an organic peroxide such as dicumyl peroxide or 1,1-bis(t-butylperoxy)cyclohexane. If necessary, a commercial antioxidant or the like may be suitably added.

More specifically, as the above core-forming rubber composition, preferred use may be made of a material obtained by blending together:

100 parts by weight of a base rubber composed of (a) from 20 to 100 wt % of a polybutadiene which has a cis-1,4 bond content of at least 60%, a 1,2-vinyl bond content of not more than 2% and a viscosity η (mPa·s) at 25° C., as a 5 wt % toluene solution, of 600 or less, and which satisfies the relationship $10\times B+5\leq A\leq 10\times B+60$, where A is the Mooney viscosity ($ML_{1+4}$ (100° C.)) and B is the ratio Mw/Mn between the weight-average molecular weight (Mw) and the number-average molecular weight (Mn) of the polybutadiene, in admixture with (b) from 0 to 80 wt % of a diene-type rubber other than component (a);

(c) from 10 to 60 parts by weight of an unsaturated carboxylic acid and/or a metal salt thereof;

(d) from 0.1 to 5 parts by weight of an organosulfur compound;

(e) from 5 to 80 parts by weight of an inorganic filler; and (f) from 0.1 to 5 parts by weight of an organic peroxide.

Even more specifically with regard to the above rubber composition, the base rubber may include, as the polybutadiene of component (a), a given amount of a polybutadiene in which the cis-1,4 bond and 1,2-vinyl bond contents, the viscosity η (at 25° C.) as a 5 wt % toluene solution, and the relationship between the Mooney viscosity and η above have each been optimized.

Here, it is essential for the polybutadiene used as component (a) to have a cis-1,4 bond content of at least 60%, preferably at least 80%, more preferably at least 90%, and most preferably at least 95%; and a 1,2-vinyl bond content of 2% or less, preferably 1.7% or less, more preferably 1.5% or less, and most preferably 1.3% or less. Outside of the above range, the rebound decreases.

The polybutadiene used as component (a) must have a viscosity η (mPa·s) at 25° C., as a 5 wt % toluene solution, of 600 or less. Here, "viscosity η (mPa·s) at 25° C., as a 5 wt % toluene solution" refers to the value obtained by dissolving 2.28 g of the polybutadiene to be measured in 50 mL of toluene then, using a standard solution for viscometer calibration (JIS Z-8809) as the reference, carrying out measurement at 25° C. with a prescribed viscometer.

The polybutadiene used as component (a) must have a viscosity η (mPa·s) at 25° C., as a 5 wt % solution in toluene, of not more than 600, and in particular not more than 550, preferably not more than 500, more preferably not more than 450, and most preferably not more than 400. If the viscosity η is too high, the workability will worsen. It is recommended that the lower limit of η be at least 50, preferably at least 100, more preferably at least 150, and most preferably at least 200. If η is too low, the rebound may decrease.

The polybutadiene used as component (a), letting the Mooney viscosity ($ML_1$+4 (100° C.)) thereof be A and letting the ratio Mw/Mn between the weight-average molecular weight Mw and the number-average molecular weight Mn be B, must satisfy the relationship $10\times B+5\leq A$, preferably satisfies the relationship $10\times B+7\leq A$, more preferably satisfies the relationship $10\times B+8\leq A$, and most preferably satisfies the relationship $10\times B+9\leq A$. As the upper limit, this polybutadiene must satisfy the relationship $A\leq 10\times B+60$, preferably satisfies the relationship $A\leq 10\times B+55$, more preferably satisfies the relationship $A\leq 10\times B+50$, and most preferably satisfies the relationship $A\leq 10\times B+45$. If A is too small, the rebound will be low, whereas if A is too high, the workability will worsen.

It is recommended that the polybutadiene used as component (a), letting the Mooney viscosity ($ML_{1+4}$ (100° C.)) thereof be A and letting the viscosity at 25° C. of a 5 wt solution in toluene be η (mPa·s), be a polybutadiene which typically satisfies the relationship $\eta\geq 20\times ML-600$, preferably satisfies the relationship $\eta\geq 20\times ML-580$, more preferably satisfies the relationship $\eta\geq 20\times ML-560$, and most preferably satisfies the relationship $\eta\geq 20\times ML-540$; and the upper limit of which typically satisfies the relationship $\eta\geq 20\times ML-100$, preferably satisfies the relationship $\eta\geq 20\times ML-150$, more preferably satisfies the relationship $\eta\geq 20\times ML-200$, and most preferably satisfies the relationship $\eta\geq 20\times ML-250$. The use of polybutadiene for which and A have been optimized in this way results in polybutadiene molecules which have a high linearity, and is thus effective for imparting a better rebound.

It is recommended that the polybutadiene used as component (a) have a Mooney viscosity ($ML_{1+4}$ (100° C.)) of at least 20, preferably at least 30, more preferably at least 40, and most preferably at least 50, but not more than 80, preferably not more than 70, more preferably not more than 65, and most preferably not more than 60.

The term "Mooney viscosity" used herein refers in each instance to an industrial indicator of viscosity (JIS K6300) as measured with a Mooney viscometer, which is a type of rotary plastometer. This value is represented by the unit symbol $ML_{1+4}$ (100° C.), wherein "M" stands for Mooney viscosity, "L" stands for large rotor (L-type), and "1+4" stands for a pre-heating time of 1 minute and a rotor rotation time of 4 minutes. The "100° C." indicates that measurement was carried out at a temperature of 100° C.

The polybutadiene of component (a) is preferably one synthesized with a rare-earth catalyst. A known rare-earth catalyst may be used for this purpose.

Illustrative examples include catalysts made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon group of 1 to 8 carbons).

Preferred alumoxanes include compounds of the structures shown in formulas (I) and (II) below. The alumoxane association complexes described in *Fine Chemical* 23, No. 9, 5 (1994), *J. Am. Chem. Soc.* 115, 4971 (1993), and *J. Am. Chem. Soc.* 117, 6465 (1995) are also acceptable.

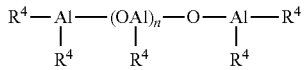

(I)

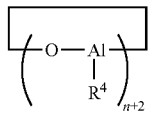

(II)

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$ (wherein X is a halogen; R is a hydrocarbon group of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$; and other metal halides such as silicon tetrachloride, tin tetrachloride and titanium tetrachloride.

The Lewis base can be used to form a complex with the lanthanide series rare-earth compound. Illustrative examples include acetylacetone and ketone alcohols.

The use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Preferred examples of such rare-earth catalysts include those mentioned in JP-A 11-35633.

The polymerization of butadiene in the presence of a rare-earth catalyst may be carried out by bulk polymerization or vapor phase polymerization, either with or without the use of solvent, and at a polymerization temperature in a range of generally −30 to +150° C., and preferably 10 to 100° C.

The polybutadiene used as component (a) in the invention may be one obtained by polymerization using the above-described rare-earth catalyst, followed by the reaction of a terminal modifier with active end groups on the polymer.

A known terminal modifier may be used for this purpose. Illustrative examples include compounds of types [i] to [vi] below:

[i] halogenated organometallic compounds, halogenated metallic compounds and organometallic compounds of the formulas $R^5_nM'X_{4-n}$, $M'X_4$, $M'X_3$, $R^5_nM'$ (—$R^6$—$COOR^7)_{4-n}$ or $R^5_nM'$ (—$R^6$—$COR^7)_{4-n}$ (wherein $R^5$ and $R^6$ are each independently a hydrocarbon group of 1 to 20 carbons; $R^7$ is a hydrocarbon group of 1 to 20 carbons which may contain pendant carbonyl or ester groups; M' is a tin, silicon, germanium or phosphorus atom; X is a halogen atom; and n is an integer from 0 to 3);

[ii] heterocumulene compounds having on the molecule a Y═C═Z linkage (wherein Y is a carbon, oxygen, nitrogen or sulfur atom; and Z is an oxygen, nitrogen or sulfur atom);

[iii] three-membered heterocyclic compounds containing on the molecule the following bonds

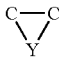

(wherein Y is an oxygen, nitrogen or sulfur atom);

[iv] halogenated isocyano compounds;

[v]carboxylic acids, acid halides, ester compounds, carbonate compounds and acid anhydrides of the formula $R^8$—$(COOH)_m$, $R^9(COX)_m$, $R^{10}$—$(COO$—$R^{11})_m$, $R^{12}$—OCOO—$R^{13}$, $R^{14}$—$(COOCO$—$R^{15})_m$ or

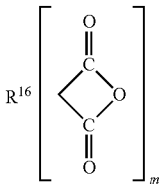

(wherein $R^8$ to $R^{16}$ are each independently a hydrocarbon group of 1 to 50 carbons, X is a halogen atom, and m is an integer from 1 to 5); and

[vi]carboxylic acid metal salts of the formula $R^{17}_lM''(OCOR^{18})_{4-l}$, $R^{19}_lM''(OCO$—$R^{20}$—$COOR^{21})_{4-l}$ or

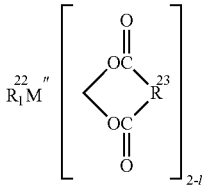

(wherein $R^{17}$ to $R^{23}$ are each independently a hydrocarbon group of 1 to 20 carbons, M" is a tin, silicon or germanium atom, and the letter l is an integer from 0 to 3).

The terminal modifiers indicated in [i] to [vi] above and methods for their reaction are described in, for example, JP-A 11-35633 and JP-A 7-268132.

Component (a) must be included within the rubber base in a ratio of at least 20 wt %, preferably at least 25 wt %, more preferably at least 30 wt %, and most preferably at least 35 wt %. The upper limit is 100 wt %, preferably 90 wt % or less, more preferably 80 wt % or less, and most preferably 70 wt % or less. Too little component (a) will make it difficult to obtain a golf ball that has been imparted with a good rebound.

Component (b) in the base rubber is an optional ingredient. Illustrative examples of component (b) include polybutadiene rubbers (BR), styrene-butadiene rubbers (SBR), natural rubbers, polyisoprene rubbers, and ethylene-propylene-diene rubbers (EPDM). These may be used singly or as combinations of two or more thereof. In order to be able to confer resilience and processability such as extrusion workability, it is preferable to use as component (b) a polybutadiene other than component (a) which has a Mooney viscosity of 55 or less, preferably 50 or less, more preferably 47 or less, and most preferably 45 or less, but not less than 10, preferably not less than 20, more preferably not less than 25, and most preferably not less than 30.

It is recommended that the polybutadiene of above component (b) be one synthesized with a group VIII catalyst. Exemplary group VIII catalysts include the following nickel catalysts and cobalt catalysts.

Here, examples of nickel catalysts include single-component systems such as nickel-kieselguhr, binary systems such as Raney nickel/titanium tetrachloride, and ternary systems such as nickel compound/organometallic compound/boron trifluoride etherate. Exemplary nickel compounds include reduced nickel on a carrier, Raney nickel, nickel oxide, nickel carboxylate and organonickel complex salts. Exemplary organometallic compounds include trialkylaluminum compounds such as triethylaluminum, tri-n-propylaluminum, triisobutylaluminum and tri-n-hexylaluminum; alkyllithium compounds such as n-butyllithium, sec-butyllithium, tert-butyllithium and 1,4-dilithiumbutane; and dialkylzinc compounds such as diethylzinc and dibutylzinc.

Examples of cobalt catalysts include cobalt and cobalt compounds such as Raney cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyldithiocarbamate, cobalt anilinium nitrite and cobalt dinitrosyl chloride. It is particularly advantageous to use these compounds in combination with, for example, a dialkylaluminum monochloride such as diethylaluminum monochloride or diisobutylaluminum monochloride; a trialkylaluminum such as triethylaluminum, tri-n-propylaluminum, triisobutylaluminum or tri-n-hexylaluminum; an alkylaluminum sesquichloride such as ethylaluminum sesquichloride; or aluminum chloride.

Polymerization using the above group VIII catalysts, and particularly a nickel or cobalt catalyst, can be carried out by a process in which the catalyst typically is continuously charged into a reactor together with a solvent and butadiene monomer, and the reaction conditions are suitably selected, such as a reaction temperature in a range of 5 to 60° C. and a reaction pressure in a range of atmospheric pressure to 70 plus atmospheres, so as to yield a product having the above-indicated Mooney viscosity.

With regard to the blending ratio, above component (b) may be included in an amount of generally 80 wt % or less, preferably 75 wt % or less, more preferably 70 wt % or less, and most preferably 65 wt % or less, with the lower limit being 0 wt % or more, preferably at least 10 wt %, more preferably at least 20 wt %, and most preferably at least 30 wt %. In the present invention, component (b) is an optional ingredient without the inclusion of which it is still possible to achieve the objects of the invention. However, when component (b) is included within the above range, even better characteristics may be imparted; that is, the extrudability is good and the manufacturing workability improves.

The above-mentioned hot-molded piece is formed of a rubber composition obtained by blending given amounts of (c) an unsaturated carboxylic acid and/or a metal salt thereof, (d) an organosulfur compound, (e) an inorganic filler, and (f) an organic peroxide as essential ingredients per 100 parts by weight of the above base rubber.

Here, the unsaturated carboxylic acid (c) is exemplified by acrylic acid, methacrylic acid, maleic acid and fumaric acid. Acrylic acid and methacrylic acid are especially preferred.

Examples of metal salts of unsaturated carboxylic acids which may be included as component (c) include zinc and magnesium salts of unsaturated fatty acids, such as zinc methacrylate and zinc acrylate. The use of zinc acrylate is especially preferred.

The unsaturated carboxylic acid and/or metal salt thereof of component (c) is included in an amount, pre 100 parts by weight of the base rubber, of at least 10 parts by weight, preferably at least 15 parts by weight, and more preferably at least 20 parts by weight, but not more than 60 parts by weight, preferably not more than 50 parts by weight, more preferably not more than 45 parts by weight, and most preferably not more than 40 parts by weight. Including too much component (c) will make the ball too hard, resulting in an unpleasant feel upon impact, whereas too little will result in the ball having a decreased rebound.

The organosulfur compound (d) is an essential ingredient for imparting an excellent rebound. Specifically, it is recommended that a thiophenol, thionaphthol, halogenated thiophenol or a metal salt thereof be included. Illustrative examples include pentachlorothiophenol, pentafluorothiophenol, pentabromothiophenol, p-chlorothiophenol, and the zinc salt of pentachlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

The amount of the organosulfur compound (d) included per 100 parts by weight of the base rubber is at least 0.1 part by weight, preferably at least 0.2 part by weight, and even more preferably at least 0.5 part by weight, but not more than 5 parts by weight, preferably not more than 4 parts by weight, more preferably not more than 3 parts by weight, and most preferably not more than 2 parts by weight. Including too much organosulfur compound will excessively lower the hardness, whereas including too little will make it impossible to improve the rebound.

The inorganic filler (e) is exemplified by zinc oxide, barium sulfate and calcium carbonate. The amount of the inorganic filler included per 100 parts by weight of the base rubber is at least 5 parts by weight, preferably at least 7 parts by weight, more preferably at least 10 parts by weight, and most preferably at least 13 parts by weight, but not more than 80 parts by weight, preferably not more than 50 parts by weight, more preferably not more than 45 parts by weight, and most preferably not more than 40 parts by weight. Too much or too little inorganic filler will make it impossible to achieve a suitable weight and a good rebound.

The organic peroxide (f) may be a commercial product, examples of which include those available under the trade names Percumyl D, Perhexa 3M, Perhexa C, Perhexa HC and Perhexa TMH (all produced by NOF Corporation), and Luperco 231XL (Atochem Co.). If necessary, two or more different organic peroxides may be used in admixture.

The amount of the organic peroxide (f) included per 100 parts of the base rubber is at least 0.1 part by weight, preferably at least 0.3 part by weight, more preferably at least 0.5 part by weight, and most preferably at least 0.7 part by weight, but preferably not more than 5 parts by weight, more preferably not more than 4 parts by weight, even more preferably not more than 3 parts by weight, and most preferably not more than 2 parts by weight. Including too much or too little organic peroxide will prevent a suitable hardness profile from being achieved, making it impossible to achieve the desired feel, durability and rebound.

An antioxidant may be included if necessary. Illustrative examples of commercial antioxidants include Nocrac NS-6 and Nocrac NS-30 (both produced by Ouchi Shinko Chemical Industry Co., Ltd.), and Yoshinox 425 (Yoshitomi Pharmaceutical Industries, Ltd.). To achieve a good rebound and durability, it is recommended that the amount of antioxidant included per 100 parts by weight of the base rubber be generally 0 or more part by weight, preferably at least 0.05 part by weight, more preferably at least 0.1 part by weight, and most preferably at least 0.2 part by weight, but not more than 3 parts by weight, preferably not more than 2 parts by weight, more preferably not more than 1 part by weight, and most preferably not more than 0.5 part by weight.

The core (hot-molded piece) may be obtained by vulcanization and curing according to a method similar to that used for conventional golf ball rubber compositions. In such cases, vulcanization may be carried out at a temperature of from 100 to 200° C. for a period of from 10 to 40 minutes.

In a single-layer core (i.e., single core), it is recommended that the core is formed to a diameter of at least 30 mm, preferably at least 32 mm, more preferably at least 34 mm, most preferably at least 35 mm, but not more than 40.0 mm, preferably not more than 39.5 mm, more preferably not more than 39.0 mm.

It is also recommended that the center hardness of the single core on a JIS-C scale be at least 40, preferably at least 42, more preferably at least 44, and most preferably at least 46, but not more than 65, preferably not more than 63, more preferably not more than 61, and most preferably not more than 59. It is further recommended that the surface hardness of the single core on a JIS-C scale be at least 75, preferably at least 77, more preferably at least 79, and most preferably at least 81, but not more than 95, preferably not more than 93, more preferably not more than 91, and most preferably not more than 89.

In the above case, it is recommended that the difference between the center hardness and the surface hardness on a JIS-C scale in the core be at least 10, preferably at least 12, more preferably at least 13, and most preferably at least 15, but not more than 35, preferably not more than 31, more preferably not more than 27, and most preferably not more than 23.

Also, the solid core may comprise a center core and an outer core around the center core. That construction of the solid core realizes the reduction of the spin rate when hitting, thereby to increase the flight distance of the golf balls substantially.

In the above case, it is recommended that the center core be formed to a diameter of at least 15 mm, preferably at least 20 mm, more preferably at least 22 mm, and most preferably at least 24, but not more than 36 mm, preferably not more than 33 mm, more preferably not more than 30 mm, and most preferably not more than 28 mm.

It is also recommended that the center hardness of the center core on a JIS-C scale be at least 40, preferably at least 42, more preferably at least 44, and most preferably at least 46, but not more than 60, preferably not more than 58, more preferably not more than 56, and most preferably not more than 54. It is further recommended that the surface hardness of the center core on a JIS-C scale be at least 55, preferably at least 57, more preferably at least 59, and most preferably at least 61, but not more than 75, preferably not more than 73, more preferably not more than 71, and most preferably not more than 69.

In the center core, the difference between the center hardness and the surface hardness on a JIS-C scale is at least 10. It is recommended that the difference of the hardness on a JIS-C scale therebetween be at least 12, preferably at least 13, and more preferably at least 15, but not more than 25, preferably not more than 23, and more preferably not more than 20.

It is recommended that the outer core have a thickness of at least 1.5 mm, preferably at least 2 mm, more preferably at least 2.5 mm, and most preferably 3 mm, but not more than 10 mm, preferably not more than 9 mm, more preferably not more than 8 mm, and most preferably not more than 7 mm.

The outer core is harder than the surface hardness of the center core. In particular, it is recommended that the difference between the hardness of the outer core and the surface hardness of the center core be at least 2, preferably at least 3, and more preferably at least 4, but not more than 30, preferably not more than 20, and more preferably not more than 15. It is recommended that a surface hardness of the outer core on a JIS-C scale be at least 75, preferably at least 77, more preferably at least 79, and most preferably at least 81, but not more than 95, preferably not more than 93, more preferably not more than 91, and most preferably not more than 89.

The cross-sectional hardness 1 mm outside the border between the center core and the outer core on a JIS-C scale is at least 65, preferably at least 68, more preferably at least 71, and most preferably at least 74, but not more than 85, preferably not more than 83, more preferably not more than 80, and most preferably not more than 77.

In the above case, the center core and the outer core are formed by an injection molding process and a compression molding process, respectively. It is preferred that the unvulcanized rubber composition for the outer core is filled into the cavity of a mold used for a preparation of hemispherical cups and subjected to semi-vulcanization at 100 to 160° C. for 1 to 10 minutes so as to form a pair of hemispherical cups in the state of semi-vulcanization. Then the pair of cups are fitted each other and the pair of cups cover the center core to prepare a solid core consisting of the center core and the outer core by a press molding process into a cavity of the mold at 100 to 200° C. for 5 to 20 minutes.

Next, the cover used in the golf ball of the invention is described. As mentioned above, the cover used in the inventive golf ball is a cover composed of two or more layers, including an inner cover layer and an outermost cover layer. The ranges in the hardnesses and thicknesses of the respective cover layers differ as described below depending on the hardness relationship between the inner cover layer and the outermost cover layer.

Cases where the Outermost Cover Layer is Softer than the Inner Cover Layer

In such cases, the outermost cover layer has a thickness of at least 0.5 mm, preferably at least 0.7 mm, and more preferably at least 0.9 mm, but not more than 1.8 mm, preferably not more than 1.5 mm, more preferably not more than 1.3 mm, and most preferably not more than 1.1 mm. If the thickness of this cover layer is greater than the above range, the rebound may decrease, shortening the distance traveled. In addition, the spin rate may rise, as a result of which an increased distance may be achieved. On the other hand, if the thickness of this cover layer is too small, the durability of the ball to repeated impact may decline, in addition to which the color of the core or intermediate layer may show through, possibly preventing the desired color tone from being achieved.

The outermost cover layer has a Shore D hardness of at least 40, preferably at least 45, and more preferably at least 50, but not more than 65, preferably not more than 60, and more preferably not more than 58. If this cover layer is too hard, the durability of the ball to repeated impact may decline and the ball may have an excessively hard feel on impact. On the other hand, if this cover layer is too soft, the ball may have a lower rebound and an increased spin rate, which may result in a shorter distance of travel.

The inner cover layer has a thickness of at least 0.5 mm, preferably at least 0.8 mm, more preferably at least 1.2 mm, and most preferably at least 1.5 mm, but not more than 4 mm, preferably not more than 3.5 mm, more preferably not more than 3 mm, and even more preferably not more than 2.5 mm. If this cover layer has a thickness which is greater than the above range, the rebound may decrease, shortening the distance traveled. On the other hand, if the thickness of this cover layer is too small, the durability of the ball to repeated impact may decline.

The inner cover layer has a Shore D hardness of at least 40, preferably at least 45, and more preferably at least 50, but not more than 70, preferably not more than 65, and more preferably not more than 60. If the inner cover layer is too hard, the durability of the ball to repeated impact may decline and the ball may have an excessively hard feel on impact. On the other hand, if this cover layer is too soft, the ball may have a lower rebound and an increased spin rate, which may result in a shorter distance of travel.

Cases where the Outermost Cover Layer is Harder than the Inner Cover Layer

In such cases, the outermost cover layer has a thickness of at least 1.0 mm, preferably at least 1.1 mm, and more preferably at least 1.3 mm, but not more than 2.3 mm, preferably not more than 2.1 mm, more preferably not more than 1.8 mm, and even more preferably not more than 1.6 mm. If this cover layer has a thickness which is greater than the above range, the rebound may decrease, shortening the distance traveled. In addition, the spin rate may rise, preventing an increase in distance from being achieved. On the other hand, if the thickness of this cover layer is too small, the durability of the ball to repeated impact may decline, in addition to which the color of the core or intermediate layer may show through, possibly preventing the desired color tone from being achieved.

The outermost cover layer has a Shore D hardness of at least 50, preferably at least 55, and more preferably at least 57, but not more than 65, preferably not more than 62, and more preferably not more than 60. If this cover layer is too hard, the durability of the ball to repeated impact may decline and the ball may have an excessively hard feel on impact. On the other hand, if this cover layer is too soft, the ball may have a lower rebound and an increased spin rate, which may result in a shorter distance of travel.

The inner cover layer has a thickness of at least 0.5 mm, preferably at least 0.8 mm, more preferably at least 1.2 mm, and even more preferably at least 1.5 mm, but not more than 4.0 mm, preferably not more than 3.5 mm, more preferably not more than 3.0 mm, and even more preferably not more than 2.5 mm. If this cover layer has a thickness which is greater than the above range, the rebound may decrease, shortening the distance traveled. On the other hand, if the thickness of this cover layer is too small, the durability of the ball to repeated impact may decline.

The inner cover layer has a Shore D hardness of at least 30, preferably at least 35, more preferably at least 40, and even more preferably at least 45, but not more than 60, preferably not more than 58, and more preferably not more than 55. If the inner cover layer is too hard, the durability of the ball to repeated impact may decline and the ball may have an excessively hard feel on impact. On the other hand, if this cover layer is too soft, the ball may have a lower rebound and an increased spin rate, which may result in a shorter distance of travel.

The base resin of the cover materials—including those for the inner cover layer and the outermost cover layer—employed in the present invention may be any thermoplastic resin or thermoset resin. Any one resin, or mixture of two or more resins, selected from among thermoplastic resins, thermoset resins and thermoplastic elastomers may be used as the main component of the cover base resin. Specifically, preferred use may be made of at least one type, or of two or more types, selected from among thermoplastic block copolymers, polyester elastomers, polyamide elastomers, polyurethane elastomers and ionomeric resins. An ionomeric resin or a polyurethane elastomer is preferred. The use of an ionomeric resin is especially preferred because ionomeric resins undergo less yellowing over time than polyurethane elastomers.

Alternatively, the cover materials may be formed of a heated mixture selected from among (I) to (III) below.

Mixture (I)

(a) 100 parts by weight of an olefin-unsaturated carboxylic acid random copolymer and/or an olefin-unsaturated carboxylic acid-unsaturated carboxylic acid ester random copolymer, (b) from 5 to 100 parts by weight of a fatty acid or fatty acid derivative having a molecular weight of from 280 to 1500, and (c) from 0.1 to 10 parts by weight of a basic inorganic metal compound capable of neutralizing acid groups within above components (a) and (b).

Mixture (II)

(d) 100 parts by weight of a metal ion neutralization product of an olefin-unsaturated carboxylic acid random copolymer and/or an olefin-unsaturated carboxylic acid-unsaturated carboxylic acid ester random copolymer, (b) from 5 to 100 parts by weight of a fatty acid or fatty acid derivative having a molecular weight of from 280 to 1500, and (c) from 0.1 to 10 parts by weight of a basic inorganic metal compound capable of neutralizing acid groups within above components (d) and (b).

Mixture (III)

100 parts by weight of a mixture of (a) an olefin-unsaturated carboxylic acid random copolymer and/or an olefin-unsaturated carboxylic acid-unsaturated carboxylic acid ester random copolymer with (d) a metal ion neutralization product of an olefin-unsaturated carboxylic acid random copolymer and/or an olefin-unsaturated carboxylic acid-unsaturated carboxylic acid ester random copolymer, (b) from 5 to 100 parts by weight of a fatty acid or fatty acid derivative having a molecular weight of from 280 to 1500, and (c) from 0.1 to 10 parts by weight of a basic inorganic metal compound capable of neutralizing acid groups within above components (a), (d) and (b).

By using such a material, advantage can be taken of the workability during molding of the cover materials—including those for the inner cover layer and the outermost cover layer, enabling a ball having a high rebound to be obtained.

Each of these components is described below. First, above component (a) is an olefin-containing copolymer. The olefin in component (a) is exemplified by olefins in which the number of carbons is at least 2 but not more than 8, and preferably not more than 6. Illustrative examples of such olefins include ethylene, propylene, butene, pentene, hexene, heptene and octene. The use of ethylene is especially preferred.

Illustrative examples of the unsaturated carboxylic acid in component (a) include acrylic acid, methacrylic acid, maleic acid and fumaric acid. Acrylic acid and methacrylic acid are especially preferred.

The unsaturated carboxylic acid ester in component (a) may be, for example, a lower alkyl ester of an unsaturated carboxylic acid. Illustrative examples include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, isobutyl acrylate) is especially preferred.

The random copolymer serving as component (a) in the invention may be obtained by the random copolymerization of the above ingredients in accordance with a known method. It is recommended that the unsaturated carboxylic acid content (acid content) within the random copolymer be generally at least 2 wt %, preferably at least 6 wt %, and more preferably at least 8 wt %, but not more than 25 wt %, preferably not more than 20 wt %, and more preferably not more than 15 wt %. At a low acid content, the rebound may decrease, whereas at a high acid content, the processability of the material may decrease.

Component (d) may be obtained by neutralizing some of the acid groups in the random copolymer of component (a) with metal ions.

Examples of metal ions for neutralizing the acid groups include $Na^{+}$, $K^{+}$, $Li^{+}$, $Zn^{++}$, $Cu^{++}$, $Mg^{++}$, $Ca^{++}$, $Co^{++}$, $Ni^{++}$ and $Pb^{++}$. Of these, $Na^{+}$, $Li^{+}$, $Zn^{++}$, $Mg^{++}$ and $Ca^{++}$ are preferred, and $Zn^{++}$ is especially preferred. The degree of neutralization of the random copolymer by these metal ions, while not subject to any particular limitation, is generally at least 5 mol %, preferably at least 10 mol %, and especially at least 20 mol %, but not more than 95 mol %, preferably not more than 90 mol %, and especially not more than 80 mol %. At a degree of neutralization in excess of 95 mol %, the moldability may decrease. On the other hand, at less than 5 mol %, there arises a need to increase the amount in which the inorganic metal compound serving as component (c) is added, which may present a drawback in terms of cost. Such a neutralization product may be obtained by a known method. For example, the neutralization product may be obtained by introducing a metal ion compound, such as a formate, acetate, nitrate, carbonate, bicarbonate, oxide, hydroxide or alkoxide, into the random copolymer.

Commercial products may be advantageously used as above components (a) and (d). Illustrative examples of the random copolymer of component (a) include Nucrel AN4311, Nucrel AN4318, Nucrel AN4319, Nucrel 1560, Nucrel N1525 and Nucrel N1035 (all available from DuPont-Mitsui Polychemicals Co., Ltd.). Illustrative examples of the neutralization product of a random copolymer of component (d) include Himilan 1554, Himilan 1557, Himilan 1601, Himilan 1605, Himilan 1706, Himilan 1855, Himilan 1856, Himilan AM7316 and Himilan AM7331 (all available from DuPont-Mitsui Polychemicals Co., Ltd.), and Surlyn 6320, Surlyn 7920, Surlyn 7930 and Surlyn 8120 (all available from E.I. DuPont de Nemours & Co.). The use of a zinc-neutralized ionomeric resin (e.g., Himilan AM7316) is especially preferred.

In cases where above components (a) and (d) are included together, the mixing ratio therebetween, while not subject to any particular limitation, may be suitably adjusted. Expressed as the weight ratio of component (a) to component (d), adjustment is preferably within a range of from 10:90 to 90:10, and especially a range of from 20:80 to 80:20.

Next, component (b) is a fatty acid or fatty acid derivative having a molecular weight of at least 280 but not more than 1500 whose purpose is to enhance the flow properties of the heated mixture. It has a molecular weight which is much smaller than those of components (a) and/or (d), and helps to significantly increase the melt viscosity of the mixture. Also, because the fatty acid (or fatty acid derivative) of component (b) has a molecular weight of at least 280 but not more than 1500 and has a high content of acid groups (or derivative moieties thereof), its addition to the resin material results in little loss of rebound.

The fatty acid or fatty acid derivative serving as component (b) may be an unsaturated fatty acid (or fatty acid derivative) having a double bond or triple bond in the alkyl moiety, or it may be a saturated fatty acid (or fatty acid derivative) in which all the bonds in the alkyl moiety are single bonds. It is recommended that the number of carbon atoms on the molecule be preferably at least 18, but preferably not more than 80, and more preferably not more than 40. Too few carbons may result in a poor heat resistance, and may also set the acid group content so high as to cause the acid groups to interact with acid groups present in component (a) and/or component (d), preventing the desired flow properties from being achieved. On the other hand, too many carbons increases the molecular weight, which may significantly lower the flow properties and make the material difficult to use.

Specific examples of fatty acids that may be used as component (b) include stearic acid, 12-hydroxystearic acid, behenic acid, oleic acid, linoleic acid, linolenic acid, arachidic acid and lignoceric acid. Of these, preferred use may be made of stearic acid, arachidic acid, behenic acid and lignoceric acid.

The fatty acid derivative of component (b) is exemplified by derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (b) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Use may also be made of known metallic soap-modified ionomers (see, for example, U.S. Pat. Nos. 5,312,857, 5,306,760 and International Disclosure WO 98/46671) when using above components (a) and/or (d), and component (b).

Component (c) is a basic inorganic metal compound capable of neutralizing the acid groups in above component (a) and/or component (d), and component (b). When, as illustrated in the prior-art examples, components (a) and/or (d) and component (b) alone, and in particular a metal-modified ionomeric resin alone (e.g., a metal soap-modified ionomeric resin of the type mentioned in the foregoing patent publications, alone), are heated and mixed, as mentioned below, the metallic soap and un-neutralized acid groups present on the ionomer undergo exchange reactions, generating a fatty acid. Because the fatty acid has a low thermal stability and readily vaporizes during molding, it causes molding defects. Moreover, if the fatty acid thus generated deposits on the surface of the molded material, it substantially lowers paint film adhesion. Component (c) is included so as to resolve such problems.

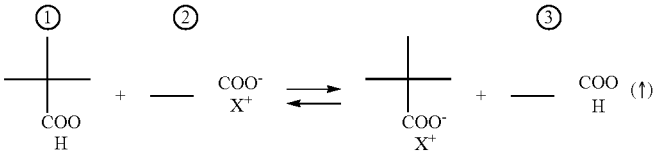

(1) un-neutralized acid group present on the ionomeric resin
(2) metallic soap
(3) fatty acid
X: metal cation It is essential that the above heated mixture include, as component (c), a basic inorganic metal compound which neutralizes the acid groups present in above component (a) and/or component (d) and in component (b). With the inclusion of component (c), the acid groups in above component (a) and/or component (d) and in component (b) are neutralized, and synergistic effects from the inclusion of each of these components increase the thermal stability of the heated mixture while at the same time conferring a good moldability, and also contribute to the rebound of the golf ball.

It is recommended that component (c) be a basic inorganic metal compound—preferably a monoxide or hydroxide— which is capable of neutralizing acid groups in above component (a) and/or component (d), and component (b). Because such compounds have a high reactivity with the ionomeric resin and the reaction by-products contain no organic matter, the degree of neutralization of the heated mixture can be increased without a loss of thermal stability.

The metal ion used here in the basic inorganic metal compound is exemplified by $Li^{+}$, $Na^{+}$, $K^{+}$, $Ca^{++}$, $Mg^{++}$, $Zn^{++}$, $Al^{+++}$, $Ni^{+}$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a monoxide or hydroxide is desirable. The use of magnesium oxide or calcium hydroxide, which have high reactivities with ionomeric resins, is preferred. Calcium hydroxide is even more preferred.

The above heated mixture, which is obtained by blending component (a) and/or component (d), component (b) and component (c) as described above, can achieve improved thermal stability, moldability and resilience. To this end, it is recommended that, in all heated mixtures used in the invention, at least 70 mol %, preferably at least 80 mol %, and more preferably at least 90 mol %, of the acid groups in the mixture be neutralized. A high degree of neutralization more reliably suppresses the exchange reactions that pose a problem in the above-described cases where component (a) and/or component (d) and the fatty acid (or fatty acid derivative) alone are used, thus making it possible to prevent the generation of fatty acids. As a result, a material can be obtained which has a markedly increased thermal stability, a good moldability, and a substantially higher resilience than conventional ionomeric resins.

Here, with regard to neutralization of the above heated mixture, to more reliably achieve both a high degree of neutralization and good flow properties, it is recommended that the acid groups in the heated mixture be neutralized with transition metal ions and with alkali metal and/or alkaline earth metal ions. Because transition metal ions have a weaker ionic cohesion than alkali metal and alkaline earth metal ions, it is possible in this way to neutralize some of the acid groups in the heated mixture and thus enable the flow properties to be significantly improved.

In this case, the molar ratio of transition metal ions and alkali (alkaline earth) metal ions is suitably adjusted, generally within a range of from 10:90 to 90:10, and most preferably in a range of from 20:80 to 80:20. If the molar ratio of the transition metal ions is low, a sufficient flow property improving effect may not be obtained. On the other hand, if the molar ratio is high, the resilience may decrease.

Here, the metal ions include at least one type of ion selected from among transition metal ions such as zinc ions, and alkali metal ions or alkaline earth metal ions such as sodium ions, lithium ions, magnesium ions and calcium ions.

The method for obtaining a heated mixture in which the acid groups have been neutralized with transition metal ions and alkali metal ions or alkaline earth metal ions is not subject to any particular limitation. By way of illustration, specific examples of methods of neutralization with transition metal ions (zinc ions) include methods in which a zinc soap is used as the fatty acid, methods in which a zinc neutralization product (e.g., a zinc-neutralized ionomeric resin) is included as component (d), and methods in which a zinc oxide is used as the basic inorganic metal compound of component (c).

Various additives may also be optionally included in the above heated mixture. Additives which may be used include pigments, dispersants, antioxidants, ultraviolet absorbers and optical stabilizers. Moreover, to improve the feel of the golf ball on impact, the heated mixture may also include, in addition to the above essential ingredients, various non-ionomeric thermoplastic elastomers. Illustrative examples of such non-ionomeric thermoplastic elastomers include olefin-based thermoplastic elastomers, styrene-based thermoplastic elastomers, ester-based thermoplastic elastomers and urethane-based thermoplastic elastomers. The use of olefin-based thermoplastic elastomers and styrene-based thermoplastic elastomers is especially preferred. Specific examples of the above olefin-based thermoplastic elastomers include those having the trade names Dynaron 6100P, Dynaron 6200P and Dynaron 6201B (all available from JSR Corporation).

The heated mixture may include, in the case of mixture (I) above, the following per 100 parts by weight of component (a): component (b) in an amount of at least 5 parts by weight, preferably at least 8 parts by weight, more preferably at least 20 parts by weight, and even more preferably at least 40 parts by weight, but not more than 100 parts by weight, preferably not more than 90 parts by weight, more preferably not more than 80 parts by weight, and even more preferably not more than 70 parts by weight; and component (c) in an amount of at least 0.1 part by weight, preferably at least 0.5 part by weight, and more preferably at least 1 part by weight, but not more than 10 parts by weight, preferably not more than 5 parts by weight, even more preferably not more than 3 parts by weight, and most preferably not more than 2 parts by weight.

In the case of mixture (II), the heated mixture may include the following per 100 parts by weight of component (d): component (b) in an amount of at least 5 parts by weight, preferably at least 8 parts by weight, more preferably at least 20 parts by weight, and even more preferably at least 40 parts by weight, but not more than 100 parts by weight, preferably not more than 90 parts by weight, more preferably not more than 80 parts by weight, and even more preferably not more than 70 parts by weight; and component (c) in an amount of at least 0.1 part by weight, preferably at least 0.5 part by weight, and more preferably at least 1 part by weight, but not more than 10 parts by weight, preferably not more than 5 parts by weight, even more preferably not more than 3 parts by weight, and most preferably not more than 2 parts by weight.

In the case of mixture (III), the heated mixture may include the following per 100 parts by weight of component (a) and component (d): component (b) in an amount of at least 5 parts by weight, preferably at least 8 parts by weight, more preferably at least 20 parts by weight, and even more preferably at least 40 parts by weight, but not more than 100 parts by weight, preferably not more than 90 parts by weight, more preferably not more than 80 parts by weight, and even more preferably not more than 70 parts by weight; and component (c) in an amount of at least 0.1 part by weight, preferably at least 0.5 part by weight, and more preferably at least 1 part by weight, but not more than 10 parts by weight, preferably not more than 5 parts by weight, more preferably not more than 3 parts by weight, and most preferably not more than 2 parts by weight.

The formation of any of mixtures (I) to (III) above, if the amount of component (b) included is low, the melt viscosity will decrease and the workability will decline. On the other hand, if the amount of component (b) is high, the durability will decrease. If the amount of component (c) included is low, improvements in thermal stability and rebound do not appear. On the other hand, if the amount of component (c) is high, the excess basic inorganic metal compound will instead lower the heat resistance of the heated mixture, hindering its use.

The inner cover layer or outermost cover layer is formed using any one of the above heated mixtures (I) to (III). However, regardless of which type of heated mixture is used, the heated mixture must have a melt index, as measured according to JIS-K6760 (at a test temperature of 190° C. and a test load of 21 N (2.16 kgf)), of at least 1.0 dg/min, preferably at least 1.5 dg/min, and more preferably at least 2.0 dg/min. In this case, if the melt index of the heated mixture is low, the processability will dramatically decrease. It is recommended that the upper limit be not more than 2.0 dg/min, and preferably not more than 15 dg/min.

Alternatively, instead of the above highly neutralized mixture, formation may be carried out using a thermoplastic or thermoset polyurethane material as the main component. When a solid golf ball is formed using such a polyurethane material as the primary material, an excellent feel, controllability, cutting resistance, scuff resistance and durability to cracking under repeated impact is obtained without a loss of rebound. In particular, it is desirable for the thermoplastic or thermoset polyurethane material described below to serve as the primary material in the outermost cover layer.

The above thermoplastic polyurethane (referred to below as "thermoplastic polyurethane (A)") has a structure which includes soft segments made of a polymeric polyol (polymeric glycol) that is a long-chain polyol, and hard segments made of a chain extender and a polyisocyanate compound. Here, the long-chain polyol used as a starting material is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties. Alternatively, advantageous use may be made of polyester polyols because of their heat resistance and the broad molecular design capabilities they provide.

Illustrative examples of the above polyether polyol include poly(ethylene glycol), poly(propylene glycol), poly(tetramethylene glycol) and poly(methyltetramethylene glycol) obtained by the ring-opening polymerization of cyclic ethers. The polyether polyol may be used singly or as a combination of two or more thereof. Of the above, poly(tetramethylene glycol) and/or poly(methyltetramethylene glycol) are preferred.

It is preferable for these long-chain polyols to have a number-average molecular weight in a range of 1,500 to 5,000. By using a long-chain polyol having a number-average molecular weight within this range, golf balls made with a thermoplastic polyurethane composition having excellent properties such as resilience and manufacturability can be reliably obtained. The number-average molecular weight of the long-chain polyol is more preferably in a range of 1,700 to 4,000, and even more preferably in a range of 1,900 to 3,000.

As used herein, "number-average molecular weight of the long-chain polyol" refers to the number-average molecular weight calculated based on the hydroxyl number measured in accordance with JIS K-1557.

Any polyisocyanate compound employed in the prior art relating to thermoplastic polyurethane materials may be used without particular limitation. Illustrative examples include 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, dimer acid diisocyanate, 2,2,4- and 2,4,4-trimethylhexamethylene diisocyanate and lysine diisocyanate. However, depending on the type of isocyanate, the crosslinking reaction during injection molding may be difficult to control. To provide a balance between stability at the time of production and the properties that are manifested, it is most preferable to use 4,4'-diphenylmethane diisocyanate as the diisocyanate.

Any chain extender employed in the prior art relating to thermoplastic polyurethane materials may be used without particular limitation, with the use of a compound having on the molecule two or more active hydrogen atoms capable of reacting with isocyanate groups being preferred. For instance, use may be made of any ordinary polyol or polyamine. Specific examples include 1,4-butylene glycol, 1,2-ethylene glycol, 1,3-butanediol, 1,6-hexanediol, 2,2-dimethyl-1,3-propanediol, dicyclohexylmethylmethanediamine (hydrogenated MDI) and isophoronediamine (IPDA). These chain extenders have a number-average molecular weight of generally at least 20, preferably at least 25, and more preferably at least 30, but generally not more than 15,000, preferably not more than 10,000, more preferably not more than 5,000, and even more preferably not more than 1,000. Aliphatic diols having 2 to 12 carbons are preferred, and 1,4-butylene glycol is especially preferred.

No limitation is imposed on the specific gravity of the thermoplastic polyurethane (A), so long as it is suitably adjusted within a range that allows the objects of the invention to be achieved. The specific gravity is preferably at least 1.0, and more preferably at least 1.1, but preferably not more than 2.0, more preferably not more than 1.7, even more preferably not more than 1.5, and most preferably not more than 1.3.

It is most preferable for the above thermoplastic polyurethane (A) to be a thermoplastic polyurethane synthesized using a polyether polyol as the long-chain polyol, using an aliphatic diol as the chain extender, and using an aromatic diisocyanate as the polyisocyanate compound. It is desirable, though not essential, for the polyether polyol to be a polytetramethylene glycol having a number-average molecular weight of at least 1,900, for the chain extender to be 1,4-butylene glycol, and for the aromatic diisocyanate to be 4,4'-diphenylmethane diisocyanate.

The mixing ratio of active hydrogen atoms to isocyanate groups in the above polyurethane-forming reaction can be adjusted within a desirable range so as to make it possible to obtain a golf ball which is composed of a thermoplastic polyurethane composition and has various improved properties, such as rebound, spin performance, scuff resistance and manufacturability. Specifically, in preparing a thermoplastic polyurethane by reacting the above long-chain polyol, polyisocyanate compound and chain extender, it is desirable to use the respective components in proportions such that the amount of isocyanate groups on the polyisocyanate compound per mole of active hydrogen atoms on the long-chain polyol and the chain extender is from 0.95 to 1.05 moles.

No particular limitation is imposed on the method of preparing the above thermoplastic polyurethane (A). Production may be carried out by either a prepolymer process or a one-shot process in which the long-chain polyol, chain extender and polyisocyanate compound are used and a known urethane-forming reaction is effected. Of these, a process in which melt polymerization is carried out in a substantially solvent-free state is preferred. Production by continuous melt polymerization using a multiple screw extruder is especially preferred.

The thermoplastic polyurethane (A) used in the invention may be a commercial product. Illustrative examples include Pandex T8290, Pandex T8295 and Pandex T8260 (all manufactured by DIC Bayer Polymer, Ltd.), and Resamine 2593 and Resamine 2597 (both manufactured by Dainichi Seika Colour & Chemicals Mfg. Co., Ltd.).

The resin which forms the cover may be composed of the above-described thermoplastic polyurethane (A). A type of polyurethane in which the molecule has a partially crosslinked structure is preferred. The use of at least one type selected from the following two types of polyurethanes (first polyurethane, second polyurethane) is especially preferred for further enhancing the scuff resistance.

First Polyurethane

A thermoplastic polyurethane composition composed of the above-described thermoplastic polyurethane (A) and an isocyanate mixture (B) is used.

The isocyanate mixture (B) is preferably one prepared by dispersing (b-1) a compound having as functional groups at least two isocyanate groups per molecule in (b-2) a thermoplastic resin that is substantially non-reactive with isocyanate. The compound having as functional groups at least two isocyanate groups per molecule which serves as component (b-1) may be an isocyanate compound used in the prior art relating to polyurethanes, examples of which include aromatic isocyanates, hydrogenated aromatic isocyanates, aliphatic diisocyanates and alicyclic diisocyanates. Specific examples include isocyanate compounds such as those mentioned above. From the standpoint of reactivity and work safety, the use of 4,4'-diphenylmethane diisocyanate is preferred.

The thermoplastic resin that is substantially non-reactive with isocyanate which serves as component (b-2) is preferably a resin having a low water absorption and excellent compatibility with thermoplastic polyurethane materials. Illustrative, non-limiting, examples of such resins include polystyrene resins, polyvinyl chloride resins, ABS resins, polycarbonate resins and polyester thermoplastic elastomers (e.g., polyether-ester block copolymers, polyester-ester block copolymers).

For good rebound resilience and strength, the use of a polyester thermoplastic elastomer is especially preferred. No particular limitation is imposed on the polyester thermoplastic elastomer, provided it is a thermoplastic elastomer composed primarily of polyester. The use of a polyester-based block copolymer composed primarily of high-melting crystalline polymer segments made of crystalline aromatic polyester units and low-melting polymer segments made of aliphatic polyether units and/or aliphatic polyester units is preferred. In addition, up to 5 mol % of polycarboxylic acid ingredients, polyoxy ingredients and polyhydroxy ingredients having a functionality of three or more may be copolymerized. In the low-melting polymer segments made of aliphatic polyether units and/or aliphatic polyester units, illustrative examples of the aliphatic polyether include poly (ethylene oxide) glycol, poly(propylene oxide) glycol, poly (tetramethylene oxide) glycol, poly(hexamethylene oxide) glycol, copolymers of ethylene oxide and propylene oxide, ethylene oxide addition polymers of poly(propylene oxide) glycols, and copolymers of ethylene oxide and tetrahydrofuran. Illustrative examples of the aliphatic polyester include poly(ε-caprolactone), polyenantholactone, polycaprylolactone, poly(butylene adipate) and poly(ethylene adipate). Examples of polyester thermoplastic elastomers preferred for use in the invention include those in the Hytrel series made by DuPont-Toray Co., Ltd., and those in the Primalloy series made by Mitsubishi Chemical Corporation.

When the isocyanate mixture (B) is prepared, it is desirable for the relative proportions of above components (b-2) and (b-1), expressed as the weight ratio (b-2)/(b-1), to be within a range of 100/5 to 100/100, and especially 100/10 to 100/40. If the amount of component (b-1) relative to component (b-2) is too low, more isocyanate mixture (B) must be added to achieve an amount of addition adequate for the crosslinking reaction with the thermoplastic polyurethane (A). In such cases, component (b-2) exerts a large influence, which may make the physical properties of the thermoplastic polyurethane composition serving as the cover material inadequate. If, on the other hand, the amount of component (b-1) is too high, component (b-1) may cause slippage to occur during mixing, making it difficult to prepare the thermoplastic polyurethane composition used as the cover material.

The isocyanate mixture (B) can be prepared by blending component (b-1) into component (b-2) and thoroughly working together these components at a temperature of 130 to 250° C. using a mixing roll mill or a Banbury mixer, then either pelletizing or cooling and grinding. The isocyanate mixture (B) used may be a commercial product, a preferred example of which is Crossnate EM30 (made by Dainichi Seika Colour & Chemicals Mfg. Co., Ltd.). Above component (B) is included in an amount, per 100 parts by weight of component (A), of generally at least 1 part by weight, preferably at least 5 parts by weight, and more preferably at least 10 parts by weight, but generally not more than 100 parts by weight, preferably not more than 50 parts by weight, and more preferably not more than 30 parts by weight. Too little component (B) may make it impossible to achieve a sufficient crosslinking reaction, so that there is no apparent enhancement of the physical properties. On the other hand, too much may result in greater discoloration over time or due to the effects of heat and ultraviolet light, and may also have other undesirable effects, such as lowering the rebound.

Second Polyurethane

At least one cover layer is made of a molded resin composition consisting primarily of the above-described thermoplastic polyurethane (A) and a polyisocyanate compound (C). The resin composition has present therein a polyisocyanate compound within at least some portion of which all the isocyanate groups on the molecule remain in an unreacted state. Golf balls made with such a thermoplastic polyurethane have an excellent rebound, spin performance and scuff resistance.

The cover layer is composed mainly of a thermoplastic polyurethane, and is formed of a resin composition of primarily a thermoplastic polyurethane (A) and a polyisocyanate compound (C).

To fully exhibit the advantageous effects of the above-described golf ball, a necessary and sufficient amount of unreacted isocyanate groups should be present in the cover-forming resin material. Specifically, it is recommended that the combined weight of above components A and C together be at least 60%, and preferably at least 70%, of the total weight of the cover layer.

Concerning the polyisocyanate compound used as component C, it is essential that, in at least some portion thereof within a single resin blend, all the isocyanate groups on the molecule remain in an unreacted state. That is, polyisocyanate compound in which all the isocyanate groups on the molecule remain in a completely free state should be present within a single resin blend, and such a polyisocyanate compound may be present together with polyisocyanate compound in which one end of the molecule is in a free state.

Various isocyanates may be used without particular limitation as the polyisocyanate compound. Specific examples include one or more selected from the group consisting of 4,4'-diphenylmethane diisocyanate, 2,4- (or 2,6-) toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Of the above group of isocyanates, using 4,4'-diphenylmethane diisocyanate, dicyclohexylmethane diisocyanate and isophorone diisocyanate is preferred for achieving a good balance between the effect on moldability by, for example, the rise in viscosity associated with reaction with the thermoplastic polyurethane (A), and the properties of the resulting golf ball cover material.

A thermoplastic elastomer other than the above-described thermoplastic polyurethane may be included as component D together with components A and C. Including this component D in the above resin composition enables the flow properties of the resin composition to be further improved and enables various properties required of golf ball cover materials, such as resilience and scuff resistance, to be increased.

Component D, which is a thermoplastic elastomer other than the above thermoplastic polyurethane, is exemplified by one or more thermoplastic elastomer selected from among polyester elastomers, polyamide elastomers, ionomeric resins, styrene block elastomers, hydrogenated styrene-butadiene rubbers, styrene-ethylene/butylene-ethylene block copolymers and modified forms thereof, ethylene-ethylene/butylene-ethylene block copolymers and modified forms thereof, styrene-ethylene/butylene-styrene block copolymers and modified forms thereof, ABS resins, polyacetals, polyethylenes and nylon resins. The use of polyester elastomers, polyamide elastomers and polyacetals is especially preferred because, owing to reactions with isocyanate groups, the resilience and scuff resistance are enhanced while retaining a good manufacturability.

The relative proportions of above components A, C and D are not subject to any particular limitation, although to fully achieve the advantageous effects of the invention, it is preferable for the weight ratio A:C:D of the respective components to be from 100:2:50 to 100:50:0, and more preferably from 100:2:50 to 100:30:8.

In this urethane composition, the resin composition is prepared by mixing component A with component C, and additionally mixing in also component D. It is critical to select the mixing conditions such that, of the polyisocyanate compound, at least some polyisocyanate compound is present in which all the isocyanate groups on the molecule remain in an unreacted state. For example, treatment such as mixture in an inert gas (e.g., nitrogen) or in a vacuum state must be furnished. The resin composition is then injection-molded around a core which has been placed in a mold. To smoothly and easily handle the resin composition, it is preferable for the composition to be formed into pellets having a length of 1 to 10 mm and a diameter of 0.5 to 5 mm. Isocyanate groups in an unreacted state remain in these resin pellets; the unreacted isocyanate groups react with component A or component D to form a crosslinked material while the resin composition is being injection-molded about the core, or due to post-treatment such as annealing thereafter.

The above method of molding the cover is exemplified by feeding the above-described resin composition to an injection molding machine, and injecting the molten resin composition around the core so as to form the cover. The molding temperature in this case varies according to such factors as the type of thermoplastic polyurethane, but is preferably in a range of 150 to 250° C.

When injection molding is carried out, it is desirable though not essential to carry out molding in a low-humidity environment such as by purging with an inert gas (e.g., nitrogen) or a low-temperature gas (e.g., low dew-point dry air), or by vacuum treating, some or all places on the resin paths from the resin feed area to the mold interior. Illustrative, non-limiting, examples of the medium used for transporting the resin include low-moisture gases such as low dew-point dry air or nitrogen. By carrying out molding in such a low-humidity environment, reaction by the isocyanate groups is kept from proceeding before the resin has been charged into the mold interior. As a result, polyisocyanate in which the isocyanate groups are present in an unreacted state is included to some degree in the resin molded piece, thus making it possible to reduce variable factors such as an unwanted rise in viscosity and enabling the real crosslinking efficiency to be enhanced.

Techniques that can be used to confirm the presence of polyisocyanate compound in an unreacted state within the resin composition prior to injection molding about the core include those which involve extraction with a suitable solvent that selectively dissolves out only the polyisocyanate compound. An example of a simple and convenient method is one in which confirmation is carried out by simultaneous thermogravimetric and differential thermal analysis (TG-DTA) measurement in an inert atmosphere. For example, when the resin composition (cover material) used in the invention is heated in a nitrogen atmosphere at a temperature ramp-up rate of 10° C./min, a gradual drop in the weight of diphenylmethane diisocyanate can be observed from about 150° C. On the other hand, in a resin sample in which the reaction between the thermoplastic polyurethane material and the isocyanate mixture has been carried out to completion, a weight drop from about 150° C. is not observed, but a weight drop from about 230 to 240° C. can be observed.

After the resin composition has been molded as described above, its properties as a golf ball cover can be further improved by carrying out annealing so as to induce the crosslinking reaction to proceed further. "Annealing," as used herein, refers to aging the cover in a fixed environment for a fixed length of time.

In addition to the above resin components, various optional additives may be included in the cover material. Such additives include, for example, pigments, dispersants, antioxidants, ultraviolet absorbers, ultraviolet stabilizers, parting agents, plasticizers, and inorganic fillers (e.g., zinc oxide, barium sulfate, titanium dioxide, tungsten).

When such additives are included, the amount of the additives is suitably selected. It is generally desirable for such additives to be included in an amount, per 100 parts by weight of the thermoplastic polyurethane, of preferably at least 0.1 part by weight, and more preferably at least 0.5 part by weight, but preferably not more than 100 parts by weight, more preferably not more than 80 parts by weight, still more preferably not more than 20 parts by weight, still yet more preferably not more than 10 parts by weight, and most preferably not more than 5 parts by weight.

Molding of the cover using the thermoplastic polyurethane may be carried out by using an injection-molding machine to mold the cover over the intermediate layer which encases the core. Molding is carried out at a molding temperature of generally from 150 to 250° C.

The golf ball of the invention relates to a white golf ball that is strongly tinged with red, which ball is characterized in that the ball surface has, as expressed in the Lab color system defined by JIS Z8730, a lightness L value of at least 89, an a value of at least 2 but not more than 10, and a b value of −20 or above.

The Lab color system used herein is determined from the following formulas using the tristimulus values X, Y and Z specified in JIS Z-8730.

$$L=10Y^{1/2} \quad (1)$$

$$a=17.5(1.02x-Y)/Y^{1/2} \quad (2)$$

$$b=7.0(Y-0.847Z)/Y^{1/2} \quad (3)$$

where

L: lightness index in R. S. Hunter's color difference equations a, b: color coordinates in Hunter's color difference equations X, Y, Z: tristimulus values X, Y and Z in XYZ color system In the above Lab color system, L represents lightness and is generally determined as a value from 100 to 0. "Lightness" refers to the light or dark state of a color; that is, to the degree of luminance. A larger L value signifies greater lightness.

The a and b values indicate perceived color, with the a value representing the red-green direction and the b value representing the yellow-blue direction. A higher a value indicates more intense redness, and a lower a indicates more intense greenness. A higher b value indicates more intense yellowness, and a lower b value indicates more intense blueness. The relationship between these a and b values is summarized in Table 1 below.

TABLE 1

| | a | | |
|---|---|---|---|
| b | Negative (−) | Close to zero | Positive (+) |
| Negative (−) | blue | blue-violet | violet |
| Close to zero | green | white/gray/black | red-violet |
| Positive (+) | blue-green | yellow | red |

Generally, in commercially sold white golf balls, the L value is about 90 to 93, the a value is about 0.8, and the b value is about −11.

In the present invention, the surface of the golf ball has an L value (lightness) of at least 89, preferably at least 90, and even more preferably at least 91. If this value is too low, the ball will appear relatively small, which may disrupt the golfer's swing.

The a value is at least 2.0, and preferably at least 2.1. At an a value smaller than that the above value, it is not possible to fully achieve both stylishness and the desired look and feel of the ball to the golfer when it is played. The upper limit in the a value is not more than 10, preferably not more than 5, and more preferably not more than 4.

In the present invention, to further accentuate the quality feel of the golf ball, it is necessary for the b value to have a lower limit of −20 or above, preferably −18 or above, and more preferably −15 or above. The upper limit value, while not subject to any particular limitation, is preferably 0 or below, more preferably −3 or below, and even more preferably −5 or below.

By adjusting the b value in the above manner, the golf ball degree of whiteness can be suitably adjusted, enabling the quality feel of the golf ball to be enhanced.

The yellow index (YI) of the inventive golf ball is preferably −30 or above, more preferably −25 or above, and even more preferably −22 or above, but preferably not above −10, more preferably not above −13, and even more preferably not above −15. Expressing the yellow index (YI) as a negative value indicates that the color moves in the blue direction. The yellow index may be determined by measuring the tristimulus values X, Y and Z using a color difference meter, then inserting the values into the following formula.

$$YI=100(1.28x-1.06Z)/Y$$

In order for the surface color of the inventive golf ball to fall within the above-indicated range, it is preferable for the material making up the outermost layer of the cover to include 100 parts by weight of the base resin, from 1 to 7 parts by weight of titanium oxide, from 0.001 to 0.5 part by weight of a blue pigment, and at least 0.006 part by weight of a red pigment.

The above-mentioned titanium oxide is titanium white. The titanium white used may be rutile or anatase. These may be manufactured by a suitable process such as the sulfate process or the chloride process, and may be surface-treated with hydrous oxides of aluminum and silicon. In particular, using a surface-treated titanium oxide enhances dispersibility in the base resin, and is thus preferred. Use can also be made of, for example, ultrafine titanium oxide particles (particle size, 0.02 to 0.05 μm), high-purity titanium oxide, and titanium oxide needles (fiber diameter, 0.05 to 0.15 μm; fiber length, 3 to 12 μm).

In the practice of the invention, titanium oxide, blue pigment and red pigment may be included in the base resin of the outermost layer. Titanium oxide is included in an amount of preferably at least 1 part by weight, more preferably at least 2 parts by weight, and even more preferably at least 3 parts by weight, but not more than 7 parts by weight, more preferably not more than 6 parts by weight, and even more preferably not more than 5 parts by weight, per 100 parts by weight of the base resin. If less than 1 part by weight of titanium oxide is included, there will be a lack of hiding power and the desired titanium color will be impossible to achieve. On the other hand, at more than 7 parts by weight, the golf ball will have a strong yellow coloring that makes it look old and may thus lack stylishness.

Preferred examples of the red pigment used in the invention include inorganic pigments such as red iron oxide (hematite) and red lead oxide, and organic pigments such as quinacridone magenta, permanent red and perylene red. The use of permanent red is especially preferred.

In the golf ball of the invention, it is preferable to include at least 0.006 part by weight, more preferably at least 0.008 part by weight, and even more preferably at least 0.010 part by weight, of red pigment per 100 parts by weight of the base resin for the outermost layer. The upper limit in the amount of red pigment included is preferably not more than 0.05 part by weight, more preferably not more than 0.04 part by weight, and most preferably not more than 0.03 part by weight. If too much red pigment is included, the color of the golf ball itself will darken, which may make the ball appear smaller, and may also result in a loss of stylishness.

With the use of a golf ball featuring a red pigment, a white color having a strong yellow tinge results, making it difficult to fully achieve both stylishness and a quality feel in the ball. Hence, in the present invention, a blue pigment may be used within a range that does not compromise the effects of the invention.

Preferred examples of blue pigments that may be used include inorganic pigments such as ultramarine blue, cobalt blue and Prussian blue, and organic pigments such as phthalocyanine blue, alkali blue and indanthrone blue. The use of ultramarine blue is especially preferred. The blue pigment is included in an amount of preferably at least 0.001 part by weight, more preferably at least 0.005 part by weight, and even more preferably at least 0.01 part by weight, per 100 parts by weight of the cover base resin. The upper limit in the amount of the blue pigment included per 100 parts by weight of the base resin is preferably not more than 0.5 part by weight, more preferably not more than 0.3 part by weight, and even more preferably not more than 0.1 part by weight.

In addition, violet pigments and yellow pigments may be suitably included to a degree that does not result in a loss of the reddish coloring by the red pigment included in the invention. The lower limit in the amount of such additional pigments may be set to at least 0.001 part by weight, preferably at least 0.005 part by weight, and more preferably at least 0.01 part by weight. The upper limit in the amount of such additional pigments included is preferably not more than 0.5 part by weight, more preferably not more than 0.3 part by weight, and even more preferably not more than 0.1 part by weight. By including suitable amounts of the above-described blue pigment, violet pigment and yellow pigment, the stylishness and quality feel of the inventive golf ball can be enhanced. However, blue, violet and yellow pigments are not necessarily essential for achieving the objects of the invention. Including such pigments in amounts outside of the above range is not desirable as the resulting golf ball may appear yellowish or darker.

If necessary, various thermoplastic elastomers and various additives, such as low-molecular-weight polyethylene wax, may be included within ranges that do not compromise the clarity of the cover resin material.

A fluorescent whitener may be included in the resin material for the outermost cover layer. The amount of fluorescent whitener included per 100 parts by weight of the cover resin material is typically from 0.01 to 0.5 part by weight, preferably from 0.03 to 0.3 part by weight, and more preferably from 0.05 to 0.1 part by weight. By using a fluorescent whitener in an amount within the above range, the L value can be increased, thereby enabling the stylishness and quality feel of the ball to be enhanced.

In the present invention, numerous dimples may be formed on the surface of the cover. The dimples arranged on the cover surface generally number at least 250, preferably at least 300, and more preferably at least 325, but generally not more than 500, preferably not more than 360, and more preferably not more than 340. If the number of dimples is higher than the above range, the ball will tend to have a low trajectory, which may shorten the distance of travel. On the other hand, if the number of dimples is too small, the ball will tend to have a high trajectory, as a result of which an increased distance may not be achieved. Any one or combination of two or more dimple shapes, including circular shapes, various polygonal shapes, dewdrop shapes and oval shapes, may be suitably used. If circular dimples are used, the diameter of the dimples may be set to from 2.0 to 6.5 mm, and the depth may be set to from 0.08 mm to 0.30 mm. Moreover, the dimples may be suitably selected so as to set the value $V_0$ (the value obtained by dividing the spatial volume of each dimple below the flat plane circumscribed by the edge of that dimple by the volume of a cylinder whose base is the flat plane and whose height is the maximum depth of the dimple from the cylinder base) in a range of from 0.35 to 0.80, the value SR (the sum of the individual dimple surface areas, each defined by the surface area of the flat plane circumscribed by the edge of the dimple, expressed as a ratio with respect to the spherical surface area of the ball were it to be free of dimples) in a range of from 60 to 90%, and the value VR (the sum of the volumes of individual dimples formed below flat planes circumscribed by the dimple edges, as a percentage of the volume of the ball sphere were it to have no dimples thereon) in a range of from 0.6 to 1. Outside of these ranges, the ball may assume a trajectory that is not conducive to achieving a good distance, as a result of which the ball may fail to travel a sufficient distance when played.

The above dimples are features that form numerous raised and recessed areas on the ball surface. The diameter, number and depth of the dimples exert an influence on the appearance of the ball. Accordingly, it is preferable for the dimples to be configured in such a way as to allow the objects of the invention to be achieved. For example, if the number of dimples is too high, when light strikes the ball, the visibility of the colored ball may be diminished. That is, depending on the angle at which the ball is seen, shadows may form at the bottoms of the dimples, making the ball appear darker. Conversely, if the number of dimples is too low, when the ball is struck, the desired aerodynamic characteristics cannot be achieved, as a result of which the ball may not travel as far as desired.

To increase the distance traveled by a golf ball, it is regarded as desirable for the ball to have a low coefficient of drag CD at high velocity and a high coefficient of lift CL at low velocity. Hence, the golf ball of the invention has a low-velocity CL, which is the coefficient of lift on the ball just after being launched with an Ultra Ball Launcher (UBL) when measured at a Reynolds number of 70,000 and a spin rate of 2,000 rpm, of preferably at least 0.165, more preferably at least 0.170, and even more preferably at least 0.180. The inventive golf ball has a high-velocity CD, which is the coefficient of drag on the ball just after launch at a Reynolds number of 180,000 and a spin rate of 2,520 rpm, of preferably not more than 0.230, more preferably not more than 0.225, and even more preferably not more than 0.220. Outside of these ranges, the golf ball may not be able to achieve a good distance.

In the practice of the invention, any of various coatings may be applied to the surface of the golf ball cover. Given the need to withstand the demanding conditions of golf ball use, preferred examples include two-part curing urethane paints, particularly non-yellowing urethane paints.

The ball has a deflection, expressed as the deformation of the ball when compressed under a final load of 1,275 N (130 kgf) from an initial load of 98 N (10 kgf), of generally at least 2.0 mm, preferably at least 2.5 mm, and more preferably at least 3.0 mm, but generally not more than 5.0 mm, preferably not more than 4.0 mm, and more preferably not more than 3.7 mm. If the deformation is too small, the feel on impact may be too hard and the period of contact between the ball and the club face may be too short, which tends to result in a poor controllability. On the other hand, if the deformation is too large, the feel on impact may be too soft and the ball may have a poor durability to cracking on repeated impact.

The multi-piece solid golf ball of the invention may be manufactured by a method which entails vulcanizing a rubber composition composed primarily of polybutadiene under known vulcanization conditions to form a molded and crosslinked rubber piece (core), then successively forming an inner cover layer and an outermost cover layer over the core by a known process such as injection molding.

The multi-piece solid golf ball of the invention, which can be manufactured so as to conform with the Rules of Golf for competitive play, may be produced to a ball diameter which is not less than 42.67 mm and to a weight which is not more than 45.93 g.

As described above, in the multi-piece solid golf ball of the invention, the reddish coloring of a white golf ball is intensified, thereby changing the stylishness of the ball and improving the way the ball looks and feels to the golfer when it is played.

What is claimed:

1. A multi-piece solid golf comprising:

a core of at least one layer, a cover of at least two layers which includes an inner cover layer and an outermost cover layer, and a plurality of dimples formed on a surface of the ball, wherein the outermost cover layer has a thickness of from 1.0 to 2.3 mm and a Shore D hardness of from 50 to 65, the inner cover layer has a thickness of from 0.5 to 4.0 mm and a Shore D hardness of from 30 to 60, the outermost cover layer is harder than the inner cover layer, and the ball surface has, as expressed in the Lab color system defined by JIS Z-8730, a lightness L value of at least 89, an a value of at least 2 but not more than 10, and a b value of −20 or above, wherein the outermost layer comprises 100 parts by weight of a base resin, from 1 to 7 parts by weight of titanium oxide, from 0.001 to 0.5 part by weight of a blue pigment, and at least 0.006 part by weight of a red pigment.

2. The multi-piece solid golf ball of claim 1, wherein the outermost layer is coated with a clear urethane coating.

3. The multi-piece solid golf ball of claim 1, wherein the number of dimples formed on the ball surface is from 250 to 500 and the ball, when hit, has a coefficient of lift CL at a Reynolds number of 70,000 and a spin rate of 2,000 rpm that is at least 0.165, and a coefficient of drag CD at a Reynolds number of 180,000 and a spin rate of 2,520 rpm that is at most 0.230.

4. The multi-piece solid golf ball of claim 1, wherein the core is formed of a rubber composition comprising a base rubber composed of (a) from 20 to 100 wt % of a polybutadiene which satisfies the relationship $10\times B+8\leq A\leq 10\times B+50$, where A is the Mooney viscosity ($ML_{1+4}$ (100° C.)) and B is the ratio Mw/Mn between the weight-average molecular weight (Mw) and the number-average molecular weight (Mn) of the polybutadiene.

5. The multi-piece solid golf ball of claim 1, wherein the core is formed of a rubber composition comprising a base rubber composed of (a) from 20 to 100 wt % of a polybutadiene which satisfies the relationship $20\times ML-540\leq\eta\leq ML-250$, where ML is the Mooney viscosity ($ML_{1+4}$ (100° C.)) and $\eta r$ is the viscosity (mPa·s) at 25° C. of a 5 wt % solution in toluene.

6. The multi-piece solid golf ball of claim 5, wherein the Mooney viscosity ($ML_{1+4}$ (100° C.)) of the polybutadiene used as component (a) is from 30 to 60.

* * * * *